United States Patent [19]

Collins et al.

[11] 4,359,664

[45] Nov. 16, 1982

[54] METHOD OF MOUNTING A CATHODE AND EYELET FOR USE THEREWITH

[75] Inventors: Floyd K. Collins; Thaddeus V. Rychlewski, both of Seneca Falls, N.Y.

[73] Assignee: North American Philips Consumer Electronics Corp., New York, N.Y.

[21] Appl. No.: 165,322

[22] Filed: Jul. 2, 1980

[51] Int. Cl.[3] ..... H01J 1/94; H01J 19/48

[52] U.S. Cl. ..... 313/270; 313/285; 313/446; 313/451

[58] Field of Search ..... 313/445, 446, 451, 270, 313/285, 286, 456

[56] References Cited

U.S. PATENT DOCUMENTS

| | | | |
|---|---|---|---|
| 1,912,006 | 5/1933 | Mischler | 313/285 X |
| 1,929,699 | 10/1933 | Loppacker | 313/285 |
| 1,942,824 | 1/1934 | McLeod | 313/285 |
| 1,963,059 | 6/1934 | Mulder et al. | 313/285 X |
| 2,400,331 | 5/1946 | Bachman | 313/285 X |
| 2,400,332 | 5/1946 | Bachman | 313/285 X |
| 2,760,102 | 8/1956 | Field | 313/286 X |
| 2,928,018 | 3/1960 | Wetmore | 313/270 |
| 3,265,920 | 8/1966 | Fiore | 313/270 X |

*Primary Examiner*—Saxfield Chatmon, Jr.
*Attorney, Agent, or Firm*—Thomas A. Briody; Jack Oisher; John C. Fox

[57] ABSTRACT

A cathode eyelet has its cathode receiving end formed in an elliptical cross-section. Pressure on the long axis opens the short axis to a dimension large enough to admit the cathode. Removal of the pressure allows the sides of the ellipse defined by the short axis to collapse and frictionally retain the cathode in position until it is welded to the eyelet.

4 Claims, 4 Drawing Figures

METHOD OF MOUNTING A CATHODE AND EYELET FOR USE THEREWITH

TECHNICAL FIELD

This invention relates to cathodes and more particularly to a method of mounting such a cathode. Additionally, a cathode eyelet of specific shape is employed.

BACKGROUND ART

In the electron guns employed in cathode ray tubes it is conventional practice to mount the cathode in a multi-diametered, substantially tubular cathode eyelet. The cathode, which also is generally tubular, is welded to the smaller diametered end of the eyelet. To insure ease of insertion of the cathode into the eyelet the eyelet diameter has been made slightly larger than the diameter of the cathode. Such an arrangement is illustrated in FIGS. 1 and 2 herein.

A second eyelet configuration which has been used is shown in U.S. Pat. No. 3,351,792. Herein the eyelet portion which is to be attached to the cathode is substantially triangular in configuration. Again, to assure reasonable insertion, some dimensional tolerance must be employed. These tolerances make it difficult to maintain the cathode in a critical spacing with the first grid of the electron gun until affixation can be accomplished. Reducing the diameter of the eyelet to more closely match that of the cathode, for example, to make a frictional engagement, introduces insertion problems; further, the friction fit can harm the delicate potentially emissive material which is attached to the insertion end of the cathode.

DISCLOSURE OF INVENTION

It is, therefore, an object of this invention to obviate the disadvantages of the prior art.

It is another object of the invention to provide a new method of inserting cathodes.

These objects are accomplished, in one aspect of the invention, by the provision of a cathode eyelet which has its cathode affixation part formed as an ellipse with a major axis and a minor axis. The major axis is larger than the diameter of the cathode to be inserted therein and the minor axis is smaller than the diameter of the cathode. The cathode is inserted by first applying pressure to the elliptical portion of the eyelet inwardly across the major axis. This action causes a diminution of the major axis and an enlargement of the minor axis. The pressure applied is sufficient to enlarge the minor axis to a dimension greater than that of the cathode. The cathode is then inserted until its proper spacing from the first grid is determined and then the pressure on the major axis is removed, causing reduction in the minor axis and allowing a compressive, frictional engagement between the eyelet and the cathode.

Subsequently, the cathode is permanently affixed to the eyelet, as by welding, preferably at the points of contact between the eyelet and the cathode.

This procedure allows easy, frictional-less insertion of the cathode into an eyelet and yet provides a positive gripping action to maintain the cathode in its desired location until permanent affixation can be made.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
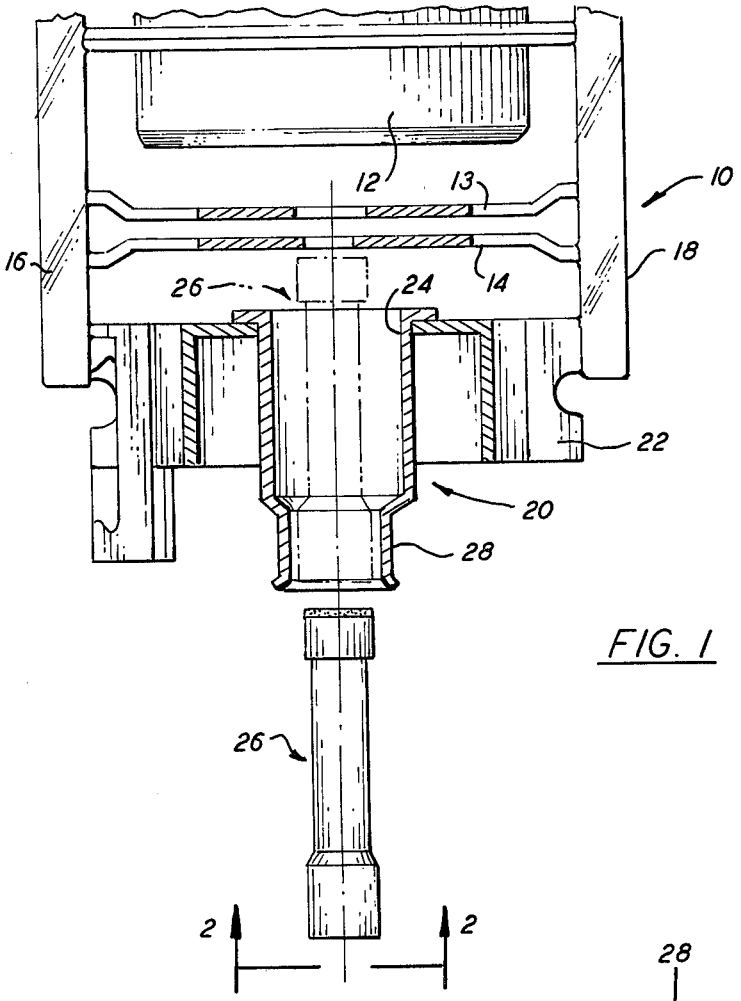
FIG. 1 is a partial, sectional view of a prior art cathode-eyelet assembly.

Referring now to the drawings with greater particularity there is shown in FIG. 1 a portion of an electron gun 10 which comprises a plurality of axially aligned grid electrodes 12, 13 and 14 held in spaced position by glass side rods 16 and 18, as is conventional. A cathode eyelet 20 is positioned adjacent grid 14 and is mounted in an eyelet support 22 which also is held by rods 16 and 18.

Cathode eyelet 20 is multi-diametered and has a first part 24 with a diameter much larger than the largest diameter of cathode 26 and a second part 28 having a diameter slightly larger than the largest diameter of cathode 26.

Figure 2:
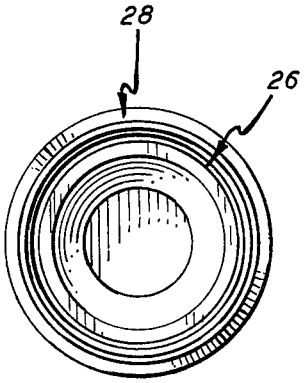
FIG. 2 is a plan view taken along the line 2—2 of FIG. 1 illustrating the prior art spacing relationship between a cathode and eyelet.

As can be seen in FIG. 2 (and in phantom in FIG. 1) the difference in diameters between second part 28 and cathode 26 makes holding the cathode 26 therein difficult after the desired insertion has been achieved.

Figure 3:
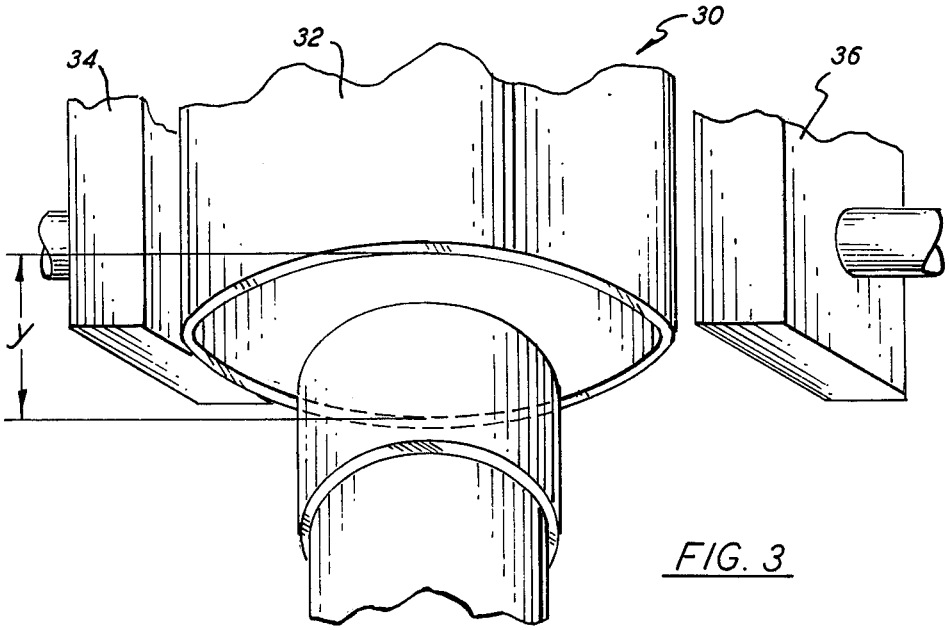
FIG. 3 is a partial perspective view of the invention.

Referring now to the invention, in FIG. 3 is shown a cathode eyelet 30 the second part 32 of which is formed with an elliptical cross-section. The ellipse has a major internal axis "x" which is larger than the diameter of cathode 26 and a minor internal axis "y" which is smaller than the diameter of cathode 26.

For a cathode 26 to be inserted, a pair of jaws 34 and 36 apply pressure inwardly along the major axis "x". This action squeezes the second part 32 causing a shortening of major axis "x" and a corresponding increase in minor axis "y". Sufficient pressure is applied to cause minor axis "y" to enlarge beyond the diameter of cathode 26. The pressure must not, however, exceed the elastic limits of the material.

Figure 4:
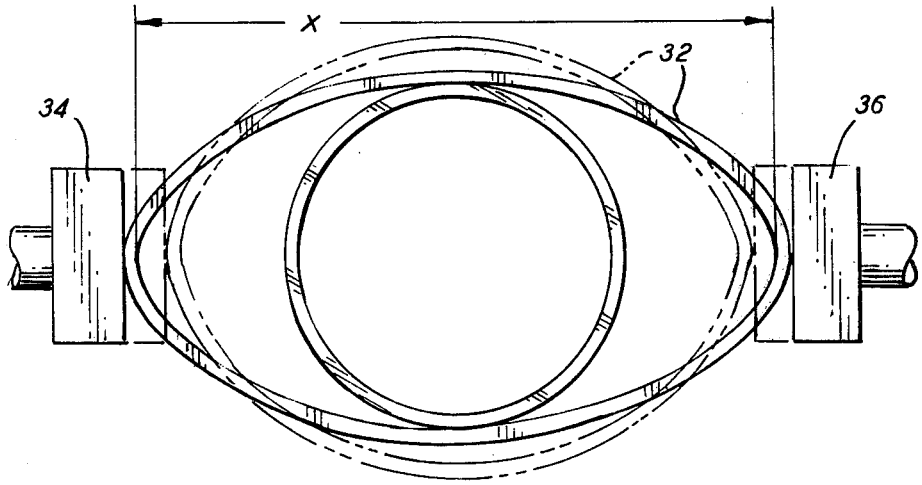
FIG. 4 is a plan view of the method of the invention with phantom lines illustrating the insertion position of the eyelet.

The change in size of the major and minor axes is shown in FIG. 4.

With the pressure still being applied by jaws 34 and 36 a cathode 26 is inserted, friction-free, into eyelet 30 a required distance. When this distance is achieved the pressure on jaws 34 and 36 is released allowing the elliptical second part 32 to return to substantially its original form and dimensions. Now, however, the sides of second part 32 defined by the minor axis frictionally engage the walls of cathode 26 and maintain the same in position. Permanent affixation, as by welding at the points of contact between part 32 and cathode 26 can now be accomplished.

Thus, there is here provided a new cathode eyelet and method of installing a cathode therein which obviates the disadvantages of the prior art.

While there has been shown and described what is at present considered the preferred embodiment of the invention, it will be apparent to those skilled in the art that various changes and modifications can be made herein without departing from the scope of the invention as defined by the appended claims.

We claim:

1. A method for inserting a cylindrical cathode into a cathode eyelet and fixing said cathode thereto, said eyelet being of a material having an elastic limit and having a first part which is substantially circular in cross-section and having a diameter larger than the diameter of said cathode and a second part which is substantially elliptical in cross-section and having a major axis which is larger than the diameter of said cathode and minor axis which is smaller than the diameter of said cathode, said method comprising the steps of: applying pressure inwardly across said major axis to compress the same while simultaneously enlarging said minor axis to a size which is larger than said cathode diameter, said pressure not to exceed the elastic limit of the material; inserting said cathode into said eyelet a desired distance; releasing said pressure on said major axis whereby said minor axis contracts until the sides of said second part frictionally engage said cathode; and fixing said cathode to said eyelet.

2. The method of claim 1 wherein said cathode is welded to said eyelet.

3. The method of claim 2 wherein said welds occur where the eyelet and cathode are frictionally engaged.

4. An eyelet for mounting a cathode cylinder of given diameter, said eyelet comprising: a hollow, tubular body of a material having an elastic limit and having a first part defined by a diameter larger than said given diameter; and a second part defined by an ellipse having a major axis and a minor axis, said major axis being larger than said given diameter and said minor axis being smaller than said given diameter.

* * * * *